United States Patent [19]

Wade

[11] 4,348,931

[45] Sep. 14, 1982

[54] SIMULATING WIND NOISE IN ELECTRONIC ORGANS USING DIGITAL NOISE GENERATORS

[75] Inventor: David R. Wade, Cincinnati, Ohio

[73] Assignee: Baldwin Piano & Organ Company, Cincinnati, Ohio

[21] Appl. No.: 142,381

[22] Filed: Apr. 21, 1980

[51] Int. Cl.[3] ..... G10H 1/02

[52] U.S. Cl. ..... 84/1.24; 84/1.25; 84/DIG. 4

[58] Field of Search ..... 84/DIG. 23, DIG. 26, 84/1.24, DIG. 4, 1.01, 1.25

[56] References Cited

U.S. PATENT DOCUMENTS

| | | | |
|---|---|---|---|
| 2,694,954 | 11/1954 | Kock | 84/1.11 |
| 3,049,959 | 8/1962 | Meyer | 84/1.24 |
| 3,479,440 | 11/1969 | Martin et al. | 84/1.25 |
| 3,529,070 | 9/1970 | Jones | 84/1.28 |
| 3,711,620 | 1/1973 | Kameoka et al. | 84/DIG. 4 |
| 3,816,635 | 6/1974 | Vetrecht | 84/1.01 |
| 3,867,862 | 2/1975 | Jones et al. | 84/1.19 |
| 4,058,042 | 11/1977 | Wade et al. | 84/1.01 |
| 4,080,861 | 3/1978 | Wholahan | 84/DIG. 4 |

OTHER PUBLICATIONS

Lancaster, CMOS Cookbook, 1977, pp. 320-323.

*Primary Examiner*—J. V. Truhe
*Assistant Examiner*—Forester W. Isen
*Attorney, Agent, or Firm*—Frost & Jacobs

[57] ABSTRACT

An electronic musical instrument of the type producing pipe organ-like sounds including a circuit for simulating wind noise by causing a random perturbation from the nominal frequency of tune, which an organ flue pipe exhibits when sounding, through the use of digital noise generators which are utilized to approximate an analog white or random noise source. The digital noise generators produce digital noise signals which are used to frequency modulate the instrument tone generator to produce substantially random perturbations in tbe generator output signal frequency. The present invention may be used with musical instruments having a single tone generator system composed of either a multiplicity of oscillators with a vibrato input, or a top octave frequency generator integrated circuit and a single oscillator with a vibrato input, or a transposer system. Furthermore, the present invention finds utility with multiple generator organ systems where all of the generators may be randomly modulated by independent and unlocked noise signals.

26 Claims, 5 Drawing Figures

SIMULATING WIND NOISE IN ELECTRONIC ORGANS USING DIGITAL NOISE GENERATORS

SUMMARY OF THE INVENTION

Modern electronic musical instruments have attained a degree of sophistication where the sounds produced are virtually indistinguishable from sounds produced by the instrument's traditional mechanically implemented counter-part. For example, electronic organs have been constructed having musical qualities which closely simulate the sounds of much more expensive conventional pipe organs. However, one tonal property that has heretofore been impossible to simulate both economically and accurately is the "wind noise" effect, or the slight amount of uncorrelated random noise perturbation which occurs naturally in conventional pipe organ tones.

The problem of precisely emulating these pipe organ characteristics has been attacked by prior art workers in a number of different and ingenious ways. For example, in U.S. Pat. No. 2,694,954 issued Nov. 23, 1954 to Winston E. Kock, a random noise generator was provided with a tuned filter for each instrument key so that the transmitted tuned noise had random amplitude which increased the choral effect of the organ sound. While this technique produced excellent results for notes played singly or in relatively small groups, a broad-band random noise sound tended to accumulate when chords consisting of many notes were played.

In U.S. Pat. No. 3,479,440 issued Nov. 18, 1969 to Daniel W. Martin et al., the stages of a frequency divider chain were perturbed in an uncorrelated fashion to introduce frequency randomness into the organ tones by utilizing sawtooth-shaped waveforms and threshold detectors, where the thresholds were caused to fluctuate by being modulated with random noise. One drawback associated with this type of technique was that the random noise was produced by an analog noise generator which resulted in occasional high amplitude bursts or spikes which were objectionable in the organ tone. It has been found that this excessive modulation effect does not occur in sounds produced by conventional organ pipes because the output amplitudes become very small when the frequency excursions are very large. Randomness produced in this manner is naturally self-limiting.

In U.S. Pat. No. 3,529,070 issued Sept. 15, 1970 to Edward M. Jones, the randomness of the tones of a pipe organ was imitated by creating side-band frequencies and controlling the amplitudes of the side-bands photoelectrically by varying the parameters of mechanically rotated frequency pattern discs. This method requires members having mechanical movement which must be controlled to a very high degree of accuracy in order to produce the required organ-like characteristics.

Finally, U.S. Pat. No. 3,867,862 issued Feb. 25, 1975 to Edward M. Jones et al. simulates certain wind noise characteristics of pipe organs by passing wide-spectrum electrical noise signal produced by analog means through a plurality of narrow band-pass filters, and electrically combining the output of the filters for addition into the appropriate organ tones. Since this arrangement utilizes an analog random noise source, it suffers somewhat from the same inadequacies discussed hereinabove with respect to the Martin et al. apparatus. It is also an expensive approach.

The present invention is directed to simulating in electronic organs the tonal effect of wind in pipe tone generation by causing random perturbations from the nominal frequency of the tone through the use of digital noise generators which are utilized to approximate an analog white (or random) noise source. This use of such digital noise generators not only eliminates the wide amplitude excursions or peaks commonly experienced with analog noise sources, but also furnishes a stable, predictable source of random perturbations which does not require calibration for each individual instrument.

Fundamentally, the present invention comprises a plurality of pseudorandom or substantially random noise generators producing output pulses of substantially constant amplitude but varying pulse width, which contain a noise energy spectrum extending over the audible frequency range of approximately 20 Hz–20 kHz. The outputs of these noise generators are mixed in exclusive OR gates to produce an uncorrelated digital noise signal having enriched energy below 20 Hz. The output of the mixer is filtered by means of a non-recursive digital sampling filter to restrict the bandwidth of the digital noise used to less than 100 Hz, since it has been determined empirically that this range of modulation frequencies produces the most pleasing pipe organ-like sounds.

The output signals resulting from the digital sampling filter are filtered by a low-pass, two-pole analog filter which removes the stop-band lobes occurring at frequencies greater than 100 Hz, which are characteristic of the digital nature of the sampling filter. The signals resulting from the analog filter are independent representations of the random perturbations of frequency that a typical flue pipe undergoes.

For those electronic instruments which have either (a) a single tone generator system composed of a multiplicity of oscillators with a vibrato input as in U.S. Pat. No. 3,049,959 issued Aug. 21, 1962 to Albert Meyer; or (b) a top-octave frequency generator integrated circuit and a single master oscillator with a vibrato input as in U.S. Pat. No. 3,816,635 issued June 11, 1974 to Dale M. Uetrecht; or (c) a transposer system such as described in U.S. Pat. No. 4,058,042 issued Nov. 15, 1977 to David R. Wade, et al., the output signals from the analog filter may be coupled by means of a level-setting network to suitable vibrato inputs of the tone generator system as will be described hereinafter, thus providing the desired modulation of the organ tone to introduce a realistic "wind noise" characteristic.

In a multiple generator system with generators detuned by standard amounts under the control of rate scalers, such as described in U.S. Pat. No. 3,816,635 issued June 11, 1974 and U.S. Pat. No. 4,056,995 issued Nov. 8, 1977, both to Dale M. Uetrecht, as well as described in copending application Ser. No. 832,353 entitled "Multiple Octave Generator Tuning System" filed Sept. 12, 1977 by Dale M. Uetrecht, and assigned to common assignee Baldwin Piano & Organ Company, direct coupled outputs from the analog filters may be applied to the inputs of voltage controlled oscillators to provide modulating signals determining the frequency shift of each generator in the chain caused by the rate scalers. Consequently, the nominal or average frequency of the voltage controlled oscillator output determines average detuning in the chain, while the instantaneous frequency is a function of the analog signal present at the control input to each voltage controlled oscillator. In addition, an independent noise signal output from an analog filter may be used to modulate the vibrato input of the topmost generator in the chain which may be a transposer derived generator of the type described in U.S. Pat. No. 4,058,042. This results in frequency modulation of the entire generator chain to provide independent frequency modulation at each of the following generators in the chain. In a preferred embodiment of the invention, independent random noise signals are applied to each of the rate scaler and topmost generator vibrato inputs. These independently produced modulating noise outputs minimize the hard beats due to electronic locking of the detuning which normally occurs in this type of system, resulting in a very pleasing ensemble affect. Further features of the invention will become apparent from the detailed description which follows.

DETAILED DESCRIPTION

Figure 1:
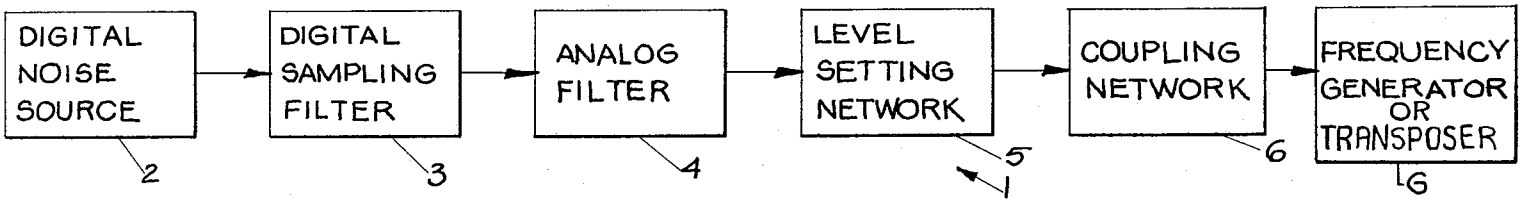
FIG. 1 is a general block diagram of the wind noise simulating system of the present invention.

Turning to the block diagram of FIG. 1, the wind noise simulating system of the present invention, shown generally at 1, includes a pseudorandom or substantially random digital noise source 2 which produces digital output pulses of substantially constant amplitude but varying pulse width having a noise energy spectrum extending to approximately 20 kHz. The output signals for digital noise source 2 are filtered by a non-recursive digital sampling filter 3 which attenuates the noise spectral energy above 100 Hz. The resulting digital noise signals are then filtered by a low-pass, two-pole analog filter 4 which further attenuates the stop-band lobes above 100 Hz, which are characteristic of the digital nature of the digital sampling filter 3. The filtered noise signals may then be applied to level setting network 5 and coupling network 6 which insure that the output signals are compatible with the modulation input port characteristics of tone generator system G. As described hereinabove, tone generator G may be a single generator system composed of a multiplicity of oscillators with a vibrato input as in U.S. Pat. No. 3,049,959; or a top octave frequency generator integrated circuit controlled by a single master oscillator with a vibrato input as in U.S. Pat. No. 3,816,635; or a transposer system such as described in U.S. Pat. No. 4,058,042. In these embodiments, the randomly occurring modulating signal from level setting network 5 is AC coupled through coupling network 6 to the appropriate frequency generator input such that tone generator G produces continuous tone output signals having a relatively stable nominal frequency until modulated. The resulting digitally produced randomly occurring noise signals frequency modulate the organ tone signals from tone generator G to produce the characteristic wind noise effect.

Alternatively, wind noise simulating system 1 of the present invention may be used with multiple rate scaler generators of the type described in application Ser. No. 832,353. In this arrangement, multiple independent randomly occurring modulating signals from a plurality of digital noise sources 2, digital sampling filters 3, analog filters 4 and level setting networks 5 are applied through a plurality of coupling networks 6 to the vibrato or modulating inputs of the rate scalers controlling frequency generators G. In a preferred embodiment, some of coupling networks 6 comprise voltage controlled oscillators which provide independent randomly occurring modulating signals to each rate scaler to determine the frequency shift of each generator in the chain. In addition, the output from an additional noise source may be AC coupled through coupling network 6 as in the embodiment described above to additionally modulate the vibrato input of the topmost generator in the chain, thus providing dual frequency modulation of subsequent generator outputs.

Figure 2:
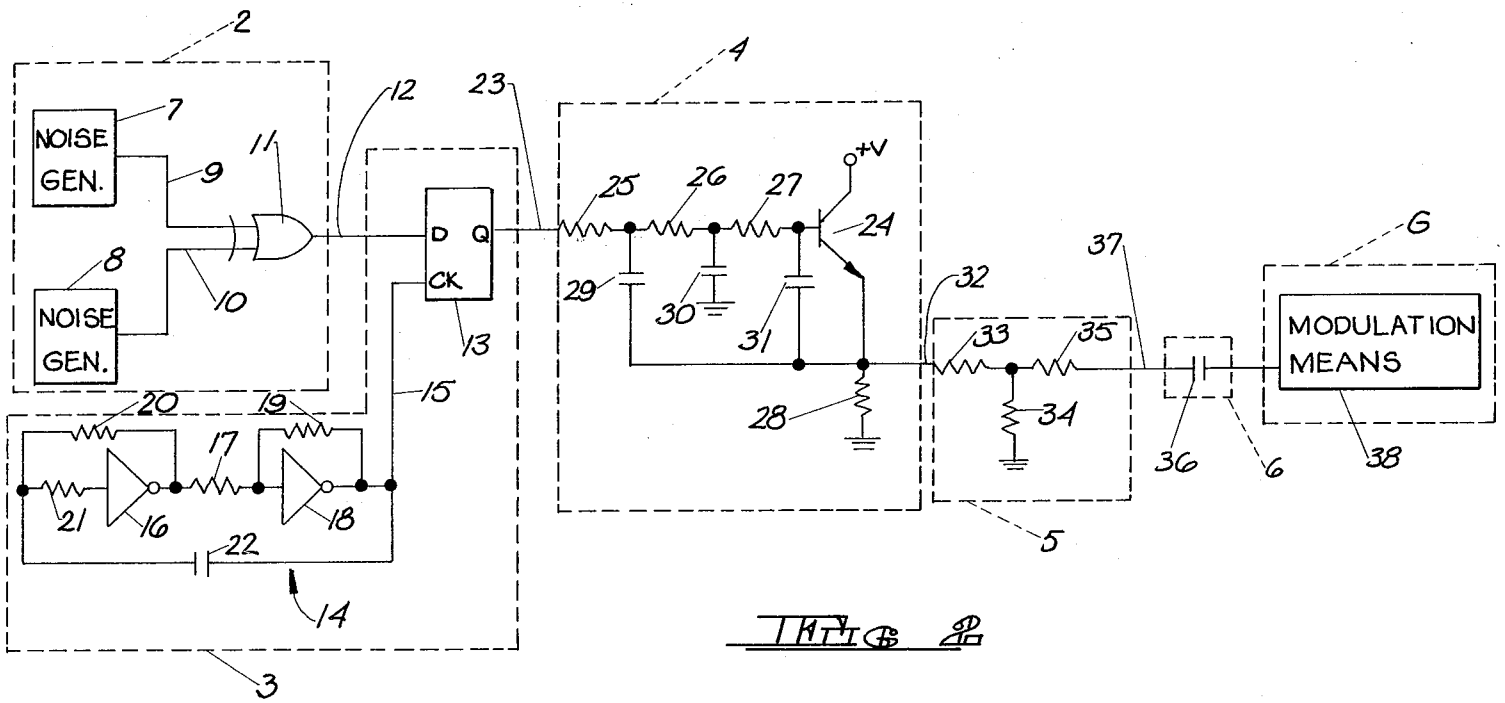
FIG. 2 is a detailed schematic diagram of the basic wind noise simulating system of the present invention producing a single modulating output.

FIG. 2 represents a preferred implementation of the wind noise simulating system illustrated in FIG. 1 for use with the first three types of tone generator systems described above. Digital noise source 2 is made up of a pair of pseudorandom or substantially random noise generators 7 and 8 which produce digital noise pulses on output lines 9 and 10 having substantially constant amplitude but varying pulse width. Typically, such noise generators utilize a shift register having internal feedback which produces a series of digital pulses of varying width which repeat periodically. For purposes of an exemplary showing, noise generator type MM5837N manufactured by National Semiconductor, can be used in the present system to create a noise energy spectrum of approximately 20 Hz–20 kHz. The use of such a digital noise generator not only eliminates unpredictable spikes which occur with analog noise generators, but also provides a measure of repeatability and interchangeability of components from system to system.

It has been found that a significant amount of the noise spectrum contributing to the wind noise effect in a conventional pipe organ occurs at lower frequencies, particularly below 100 Hz. Since most of the noise energy produced by noise generators 7 and 8 is concentrated in the spectrum above 20 Hz, additional means are necessary to enhance lower frequency components in the noise spectrum. This function is accomplished by means of exclusive OR gate 11 which acts as a means for mixing the output signals from noise generators 7 and 8 to produce a digital noise signal containing difference frequencies enriching the energy in the lower frequency region below 20 Hz.

The output from digital noise source 2 appearing on line 12 is applied to low-pass, non-recursive digital sampling filter 3 made up of D flip-flop 13 and a free running filter oscillator, shown generally at 14. As shown in FIG. 2, noise generator output 12 is applied to the D input of flip-flop 13, while the output from oscillator 14 appearing on line 15 is applied to the clock input of the flip-flop. Oscillator 14 is conventional in nature and comprises a first inverter 16 having its output coupled through resistor 17 to the input of a second inverter 18. A resistor 19 bypasses inverter 18, and a similar resistor 20 bypasses the series combination of resistor 21 and inverter 16. A timing capacitor 22 is returned from the output of inverter 18 (which also forms output line 15) to the junction of resistors 20 and 21. The frequency of oscillation of oscillator 14 is determined by the passive components and characteristics of the active components, as is well understood in the art, and will normally approximate the cutoff frequency of the digital filter 3. In the present case where a cutoff frequency of 100 Hz is required, an oscillator frequency of 110 Hz has been found satisfactory.

Figure 3:
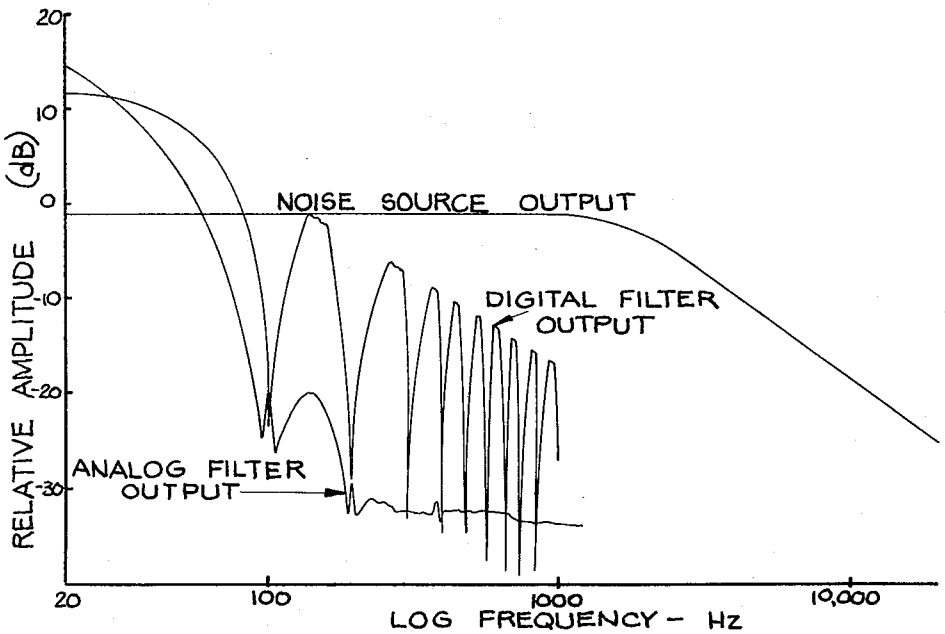
FIG. 3 is a graphical representation of the transmission characteristics of the non-recursive digital sampling filter and of the low-pass two-pole analog filter.

The output from digital filter 3 is produced at the Q output of D flip-flop 13 on line 23 as illustrated by the noise source output curve in FIG. 3. In particular, it can be seen that for the particular noise generators 7 and 8 used, the noise frequency spectrum at the output of noise source 3 extends from 20 Hz to well above 100 Hz. The noise spectrum in the output from digital filter 3 is sharply attenuated above 100 Hz, but contains a number of stop-band lobes containing significant amounts of energy above 100 Hz. These stop-band lobes may be removed by analog filter 4, the input of which is connected to output line 23 of digital filter 3.

In particular, analog filter 4 comprises a low-pass two-pole filter. While for purposes of an exemplary showing a particular filter configuration has been described and illustrated, it will be understood that equivalent low pass filter constructions may be substituted. In the embodiment shown, output line 23 of digital filter 3 is connected to the base of transistor 24 through the series combination of resistors 25, 26 and 27. The collector of transistor 24 is connected to supply voltage +V while the emitter is connected to ground through resistor 28. Capacitor 29 is connected from the junction of resistors 25 and 26 to the emitter of transistor 24. A capacitor 30 is connected from the junction of resistors 26 and 27 to ground, while the capacitor 31 is connected from the junction of resistor 27 and the base of transistor 24 to the emitter of the transistor, which forms the filter output on line 32. As can be seen in FIG. 3, the analog filter characteristic will significantly reduce the stop-band lobes above 100 Hz.

The level setting network 5 may also be used as required to provide the proper signal amplitude levels at the input of frequency generator G. In the preferred embodiment illustrated in FIG. 2, level setting network 5 comprises a T-network made up of resistors 33, 34 and 35.

For purposes of an exemplary showing, coupling network 6 is illustrated as a capacitor 36 for AC coupling the modulating output signal from level setting network 5 to the input of modulating means 38 of frequency generator G. In other arrangements, coupling network may be a simple connection or a voltage controlled oscillator, for example, to directly couple level setting network 5 with modulating means 38.

The output line 37 of coupling network 6 is connected to the input of tone generator G. As described hereinabove, generator G may be a single generator system composed of a multiplicity of oscillators with a vibrato input; or a top-octave frequency generator circuit with a single master oscillator with a vibrato input; or a transposer system such as described in the aforementioned U.S. Pat. No. 4,058,042. In any event, generator G produces a continuous output signal having a relatively stable nominal frequency from which other tones of lesser frequency may be derived. Generator G also contains a modulation or vibrato means 38 by which the output of the generator G may be randomly frequency modulated by the digitally produced noise input signal appearing on line 37 to produce substantially random perturbations in the nominal frequency of the generator output resulting in a wind noise effect in the musical instrument sound.

Figure 4A:
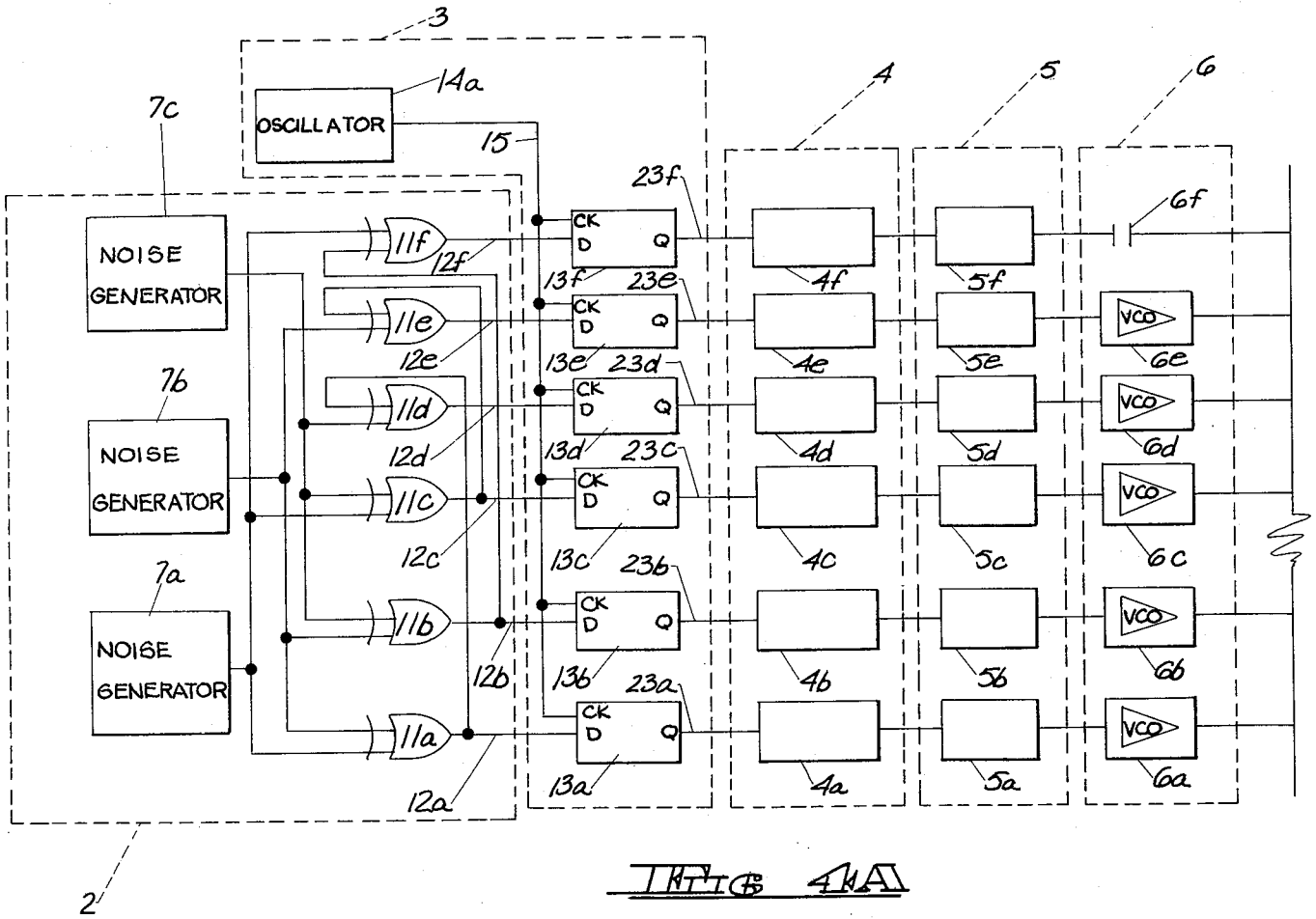
FIGS. 4A and 4B represent a block diagram of a more elaborate wind-noise modulation system for multiple generator organs.
Figure 4B:
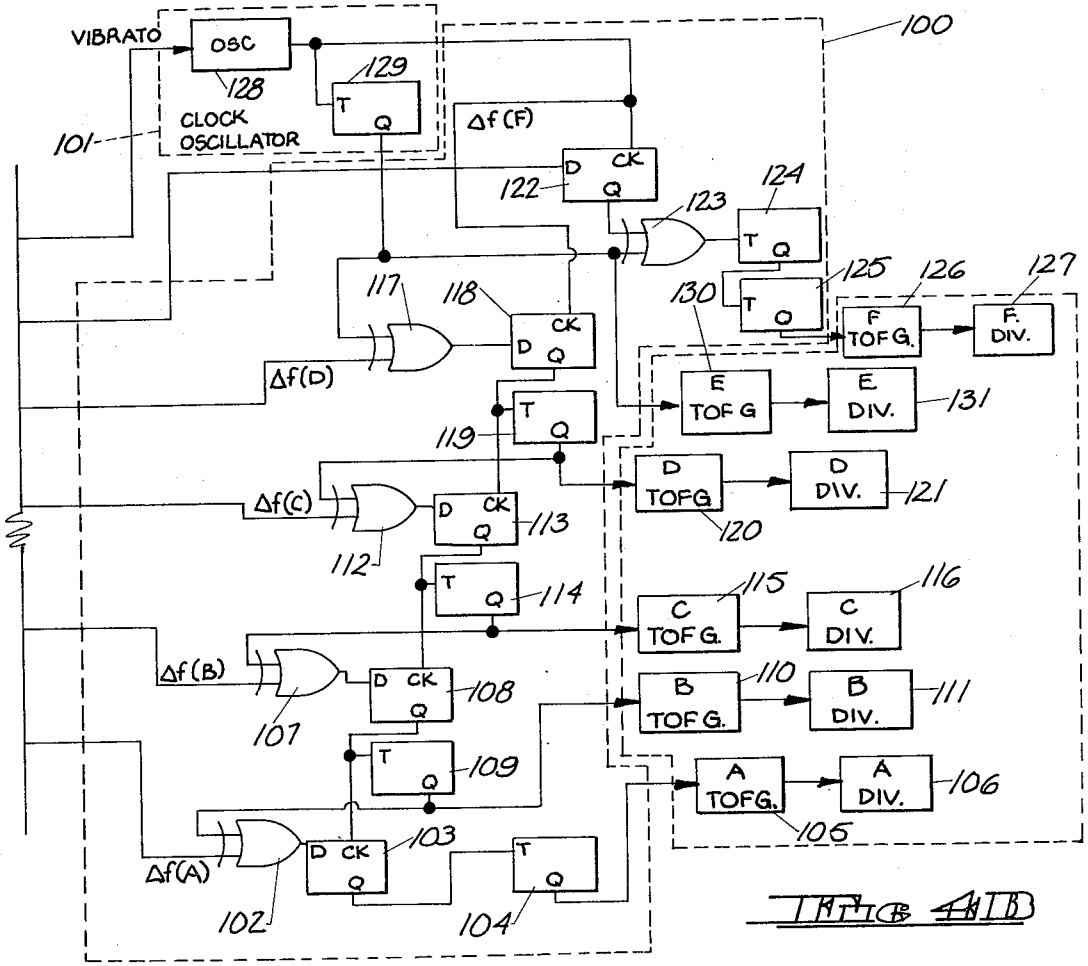

As noted above, the wind noise simulating system of the present invention may also be used with multiple generator organ systems. Such an arrangement is illustrated in FIGS. 4A–4B in combination with the type of system having a multiplicity of generators composed of a chain of rate scalers supplying top-octave frequency generators as described in copending application Ser. No. 832,353. In this embodiment, three pseudorandom or substantially random noise generators **7*a*, 7*b*, and 7*c*, similar to noise generators 7 and 8 described hereinabove in connection with the embodiment of FIG. 2, are used to create six independent random noise output signals appearing on output lines 23*a*–23*f* of digital sampling filter 3. The output from first noise generator 7*a* is connected to one input of exclusive OR gates 11*a*, 11*c* and 11*f*, respectively. The output from second noise generator 7*b* is connected to the remaining input of exclusive OR gate 11*a* and to one input of exclusive OR gates 11*b* and 11*e*, respectively. The output from noise generator 7*c* is connected to the remaining inputs of exclusive OR gates 11*b* and 11*c*, respectively, and to one input of exclusive OR gate 11*d*. The remaining inputs of exclusive OR gates 11*d*, 11*e*, and 11*f* are connected, respectively, to the output from gates 11*a*, 11*c*, and 11*b*. The outputs from exclusive OR gates 11*a*–11*f* resulting from the mixing of the noise signals form the six independent digital noise source outputs 12*a*–12*f*, which contain noise energy in the lower frequency region below 20 Hz to above 20 kHz as described hereinabove in connection with the embodiment of FIG. 2**.

Digital noise source output signals **12*a*–12*f* are applied to the respective D inputs of D flip-flops 13*a*–13*f*, which are similar to flip-flop 13 in the embodiment of FIG. 2, and together with oscillator 14*a* form digital sampling filter 3. The output from oscillator 14*a*, which may be similar to oscillator 14, is connected to the clock (CK) inputs of flip-flops 13*a*–13*f*.**

The independent outputs from digital filter 3 are produced at the Q outputs of flip-flops **13*a*–13*f* and appear on lines 23*a*–23*f*. The stop-band lobes containing energy above approximately 100 Hz may be removed by analog low pass filters 4*a*–4*f*, which may be similar in structure and function to filter 4 of the embodiment of FIG. 2. The output signals from the analog filters may be atentuated to the proper amplitude level, if required, by level setting networks 5*a*–5*f*, which may be similar to level setting networks 5** described hereinabove.

It will be observed that the randomly occurring signals produced at the output of level setting networks **5*a*–5*f*** are substantially independent and unlocked. This approach avoids the hard beats due to electronic locking which occurs when the modulating signals are derived from a common source.

The filtered noise output signals from level setting networks **5*a*–5*f* are applied to the inputs of coupling networks 6*a*–6*f*. In the embodiment illustrated in FIG. 4A–FIG. 4B, coupling networks 6*a*–6*e* comprise voltage controlled oscillators which are responsive to the modulating noise signals, and which provide the Δf inputs to the appropriate rate scalers of rate scaler chain 100. In general, the center (unmodulated) frequencies of the voltage controlled oscillators will differ by the amounts needed to produce (for organ ensemble) the slight detuning (a few cents) of the generators by the associated rate scalers. In addition, a simple coupling network consisting of a capacitor 6*f* is used to AC couple one of the modulating noise signals to the vibrato input of oscillator 101** as will be described in more detail hereinafter.

The rate scalers of chain 100 are similar to those described in the aforementioned application Ser. No. 832,353 and are used to detune subsequent generators by standard amounts under control of clock oscillator 101 which may be of the transposer type described in U.S. Pat. No. 4,058,042. In the embodiment illustrated in FIG. 4A–FIG. 4B, rate scaler chain 100 provides scaled outputs to each of the A–F generator systems made up of a top octave frequency generator (TOFG) and one or more frequency divider networks. The output from coupling network 6*a* is connected to one input of exclusive OR gate 102, while the output is connected to the D input of D flip-flop 103. The Q output of flip-flop 103 is connected to the T input of trigger flip-flop 104, while the Q output of this latter flip-flop forms the rate scaler output to A top octave frequency generator 105 and the subsequent A divider networks 106.

The output from coupling network 6*b* is connected to one input of exclusive OR gate 107, while the output of this gate is connected to the D input of D flip-flop 108. The Q output of flip-flop 108 is connected to the T input of trigger flip-flop 109 and the clock input of flip-flop 103. The Q output of flip-flop 109 is connected to the remaining input of exclusive OR gate 102 and also forms the rate scaler output to the B generator system consisting of B top octave frequency generator 110 and the subsequent B divider networks 111.

The output from coupling network 6*c* is connected to one input of exclusive OR gate 112, while the output of this gate is connected to the D input of D flip-flop 113. The Q output of flip-flop 113 is connected to the T input of trigger flip-flop 114 and the clock input of flip-flop 108. The Q output of flip-flop 114 is connected to the remaining input of gate 107, and also forms the rate scaler output to the C generator system consisting of C top octave frequency generator 115 and the subsequent C divider networks 116.

The output from coupling network 6*d* is connected to one input of exclusive OR gate 117, while the output of this gate is connected to the D input of D flip-flop 118. The Q output of flip-flop 118 is connected to the T input of trigger flip-flop 119 and to the clock input of flip-flop 113. The Q output of flip-flop 119 is connected to the remaining input of exclusive OR gate 112, and also forms the rate scaling output to the D generator system consisting of D top octave frequency generator 120 and subsequent divider networks 121.

The output from coupling network 6*e* is connected to the D input of D flip-flop 122, while the Q output of this flip-flop is connected to one input of exclusive OR gate 123. The output of gate 123 is connected to the T input of trigger flip-flop 124 while the Q output from this flip-flop is connected to the T input of trigger flip-flop 125. The Q output of flip-flop 125 forms the rate scaling output for the special celeste generator which comprises F top octave frequency generator 126 and subsequent F dividers 127.

Clock oscillator 101, which provides the source frequency in the preferred embodiment illustrated comprises oscillator means 128 which may be of the transposer type described in U.S. Pat. No. 4,058,042, and contains a VIBRATO input connected to the output of coupling network 6*f*. The output from oscillator means 128 is connected to the T input of trigger flip-flop 129, the clock input of flip-flop 122, and to the clock input of flip-flop 118. The Q output of flip-flop 129 is connected to the remaining input of exclusive OR gate 117, the remaining input of exclusive OR gate 123, and also forms the rate scaler output for the E generator system consisting of E top octave frequency generator 130 and subsequent E divider networks 131.

Each rate scaler in rate scaler chain 100 has two input signals, $f_{in}$ and $\Delta f$. The $f_{in}$ signal is obtained either directly from the output of clock oscillator 101 or from the output of the previous rate scaler in the chain. The $\Delta f$ signal comes from the associated coupling network 6*a*–6*f* as shown.

The rate scalers are so designed and connected that the output frequencies are increased or decreased by predetermined amounts $\Delta f$. For example, the A rate scaler may scale the output of the B rate scaler by $-2¢$; the B rate scaler may scale the output of the C rate scaler by $-2¢$; and so forth through the chain to the E rate scaler, the input of which receives the output from clock oscillator 101 directly (as does the special celeste generator F rate scaler, which is not in the rate scaler chain 100).

When modulating noise signals are supplied to coupling networks 6*a*–6*e* (voltage controlled oscillators in this embodiment) $\Delta f_a$–$\Delta f_e$ provide random components superimposed upon the VCO frequencies which, through the action of the previously described rate scalers, modulate the driving signals applied to each of the top octave frequency generators 105, 110, 115, 120, 126 and 130. It will be observed that the nominal or average frequency from the voltage controlled oscillators comprising coupling networks 6*a*–6*e* determines the average detuning in the various divider chains, while the instantaneous frequency is a function of the analog signal present at the control input to each voltage controlled oscillator. Furthermore, the modulating noise output from coupling network 6*f* is AC coupled to the vibrato input of oscillator means 128 to frequency modulate the entire generator chain. Since the modulating noise signals applied to oscillator means 128 and to each of the rate scalers are independent and unlocked, the hard beats due to electronic locking of the detuning which normally occurs in this type of system is eliminated, and a very pleasing ensemble effect is achieved.

It will be understood that various changes in the details, materials, steps and arrangements of parts, which have been herein described and illustrated in order to explain the nature of the invention, may be made by those skilled in the art within the principle and scope of the invention as expressed in the appended claims.

The properties of the invention in which an exclusive property or privilege is claimed are as follows:

1. In an electronic musical instrument of the type having tone generator means for producing a continuous oscillating output signal having a relatively stable nominal frequency from which other tones of a lesser frequency may be derived and means for frequency modulating said output signal in accordance with a noise modulating signal, the improvement in combination therewith comprising means connected to said tone generator means for generating said modulating signal, said modulating signal generating means comprising a digital noise source producing an output signal having digital noise pulses of substantially constant amplitude and varying pulse width, said noise source comprising a plurality of digital noise generators producing output signal pulses of substantially constant amplitude but varying pulse width, means comprising a plurality of exclusive OR gates each having a pair of inputs and an output for mixing said digital noise generator output signal pulses to produce said digital noise source output signal, each of said digital noise generator output signals being connected to at least one different exclusive OR input, at least one of said exclusive OR outputs being connected to a different one of said exclusive OR inputs, some at least of said exclusive OR outputs forming the digital noise source output signals, and filtering means for limiting the frequency band of said noise source output signal to produce said noise modulating signal, said noise modulating signal causing substantially random perturbation in the frequency of said tone generator means output signal.

2. The musical instrument according to claim 1 wherein said mixing means produces a digital noise source output containing difference frequencies resulting from frequencies occurring in said noise generator output signal pulses.

3. The musical instrument according to claim 1 wherein said mixing means produces a plurality of noise source output signals.

4. The musical instrument according to claim 3 wherein said noise source output signals are independent and unlocked.

5. The musical instrument according to claim 3 wherein said mixing means produces a number of noise source output signals greater than the number of digital noise generators.

6. The musical instrument according to claim 1 wherein said filter means attenuates frequencies greater than about 100 Hz.

7. The musical instrument according to claim 1 including means for coupling said modulating signal produced by said filtering means to said tone generator means.

8. The musical instrument according to claim 7 wherein said coupling means comprises a voltage controlled oscillator.

9. The musical instrument according to claim 7 wherein said coupling means comprises means for AC coupling said filtering means to said tone generator means.

10. The musical instrument according to claim 1 including a plurality of said tone generator means and frequency modulating means, said modulating signal generating means producing a plurality of said noise modulating signals, each of said noise modulating signals being connected to one of said frequency modulating means for causing substantially random perturbation in the frequency of the associated tone generator means output signal.

11. The musical instrument according to claim 10 wherein the output signal from at least one of said tone generator means is derived from the output signal from another of said tone generator means.

12. The musical instrument according to claim 11 wherein said plurality of noise modulating signals are independent and unlocked.

13. An electronic musical instrument comprising tone generator means for producing a master output signal of relatively stable nominal frequency from which a plurality of tone signals of lesser frequency may be derived, means connected to said tone generator means for frequency modulating said master output signal in accordance with a first substantially random noise modulating signal, means comprising a noise source for producing said first noise modulating signal, divider means responsive to said master output signal for producing said tone signals of lesser frequency, means for frequency modulating said tone signals of lesser frequency in accordance with a second substantially random noise modulating signal and means comprising a noise source for producing said second noise modulating signal.

14. The musical instrument according to claim 13 wherein said modulating signal producing means produce substantially independent and unlocked first and second modulating signals.

15. The musical instrument according to claim 13 wherein said noise sources comprise digital noise sources producing output signals having digital noise pulses of substantially constant amplitude and varying pulse width.

16. The musical instrument according to claim 15 wherein said noise sources comprise a plurality of digital noise generators producing output signal pulses of substantially constant amplitude but varying pulse width, and means for mixing said digital noise generator output signal pulses to produce said digital noise source output pulses.

17. The musical instrument according to claim 16 wherein said mixing means comprises an exclusive OR gate.

18. The musical instrument according to claim 17 including a plurality of said exclusive OR gates each having a pair of inputs and an output, each of said digital noise generator output signals being connected to at least one different exclusive OR input, at least one of said exclusive OR outputs being connected to a different one of said exclusive OR inputs, some at least of said exclusive OR outputs forming the digital noise source output signals.

19. The musical instrument according to claim 18 including filtering means for limiting the frequency band of said noise source output signal.

20. The musical instrument according to claim 13 wherein said divider means comprises at least one rate scale generator producing slightly detuned output signals.

21. The musical instrument according to claim 20 including a voltage controlled oscillator for coupling said second modulating signal to said rate scale generator.

22. In an electronic musical instrument of the type having a plurality of tone generator means for producing a continuous oscillating output signal having a relatively stable nominal frequency from which other tones of a lesser frequency may be derived, the output signal from at least one of said tone generator means being derived from the output signal of another of said tone generator means, and means for frequency modulating said output signal in accordance with a noise modulating signal, the improvement in combination therewith comprising a plurality of means connected to said tone generator means for generating a plurality of said modulating signals, said modulating signal generating means comprising a digital noise source producing an output signal having digital noise pulses of substantially constant amplitude and varying pulse width, and filtering means for limiting the frequency band of said noise source output signal to produce said noise modulating signal, each of said noise modulating signals being connected to one of said frequency modulating means for causing substantially random perturbation in the frequency of the associated tone generator means output signal, one of said tone generator means comprising a transposer system, one of said noise modulating signals being AC coupled to the modulating means associated with said transposer system for causing substantially random perturbation in the frequency of said transposer system output signal, the remaining tone generator means comprising rate scale generators producing slightly detuned output signals derived from said transposer system output signal, each of the remaining modulating noise signals being connected to one of the modulating means associated with each of said rate scale generators to introduce substantially random perturbation of the frequency of the associated rate scale generator output signal, and a voltage controlled oscillator coupling said remaining modulating noise signals to said modulating means.

23. The musical instrument according to claim 22 wherein the center frequency of each of said voltage controlled oscillators is slightly different corresponding to the amount of detuning of the associated rate scale generator.

24. In an electronic musical instrument of the type having tone generator means for producing a continuous oscillating output signal having a relatively stable nominal frequency from which other tones of a lesser frequency may be derived and means for frequency modulating said output signal in accordance with a noise modulating signal, the improvement in combination therewith comprising means connected to said tone generator means for generating said modulating signal, said modulating signal generating means comprising a digital noise source producing an output signal having digital noise pulses of substantially constant amplitude and varying pulse width, and filtering means including a low pass non-recursive digital sampling filter for limiting the frequency band of said noise source output signal to produce said noise modulating signal, said noise modulating signal causing substantially random perturbation in the frequency of said tone generator means output signal.

25. The musical instrument according to claim 24 wherein said digital sampling filter comprises a D flip-flop and a free-running oscillator, the D input of said flip-flop being responsive to said digital noise pulses and the clock input and said flip-flop being responsive to said oscillator output.

26. The musical instrument according to claim 24 wherein said filtering means includes a low pass analog filter for reducing the stop-band lobes produced by said digital filter.

* * * * *